US006817564B2

(12) United States Patent
Järvensivu et al.

(10) Patent No.: US 6,817,564 B2
(45) Date of Patent: Nov. 16, 2004

(54) METHOD AND APPARATUS IN CHANGING THE SETTING OF A SLITTER

(75) Inventors: Markku Järvensivu, Valkeakoski (FI); Heikki Föhr, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 75 days.

(21) Appl. No.: 10/312,957

(22) PCT Filed: Jun. 28, 2001

(86) PCT No.: PCT/FI01/00616

§ 371 (c)(1),
(2), (4) Date: Feb. 24, 2003

(87) PCT Pub. No.: WO02/02284

PCT Pub. Date: Jan. 10, 2002

(65) Prior Publication Data

US 2003/0155461 A1 Aug. 21, 2003

(30) Foreign Application Priority Data

Jul. 3, 2000 (FI) ..... 20001587

(51) Int. Cl.[7] ..... B65H 35/02

(52) U.S. Cl. ..... 242/525.3; 242/525.5; 83/425.4; 83/508.3

(58) Field of Search ..... 242/525.3, 525.5; 83/428, 425.4, 508.2, 508.3

(56) References Cited

U.S. PATENT DOCUMENTS 3,682,031 A * 8/1972 Degelleke et al. ..... 242/525.5
5,918,519 A 7/1999 Schnabel et al.
6,009,784 A 1/2000 Pizzi et al.
6,206,321 B1 * 3/2001 Pumpe ..... 242/525.3

FOREIGN PATENT DOCUMENTS

| | | |
|---|---|---|
| DE | 3443 849 A1 | 6/1986 |
| EP | 0 692 370 A1 | 7/1995 |
| EP | 0 816 028 A1 | 6/1997 |
| EP | 0 818 409 A1 | 6/1997 |
| EP | 0 894 583 A2 | 7/1998 |
| WO | WO 02/02284 A1 | 1/2002 |

OTHER PUBLICATIONS

Search report issued in Finnish Priority Application No. 20001587.

International Search Report issued in International Patent Application No. PCT/FI01/00616.

International Preliminary Examination Report issued in International Patent Application No. PCT/FI01/00616.

* cited by examiner

*Primary Examiner*—John M. Jillions
(74) *Attorney, Agent, or Firm*—Stiennon & Stiennon

(57) ABSTRACT

When the setting of a web slitter winder blades (41, 42) is changed during slitting in order to slit component webs ($W_o$) of different widths, the width of the edge trimming formed changes and an untrimmed neck remains between the edge trimmings of different widths. A cutting apparatus (50) makes a cut between the slitting line of an edge trimming according to an old blade setting and the slitting line of an edge trimming according to a new blade setting controlled by a control system (59).

12 Claims, 2 Drawing Sheets

METHOD AND APPARATUS IN CHANGING THE SETTING OF A SLITTER

CROSS REFERENCES TO RELATED APPLICATIONS

This application is a U.S. national stage application of International Application No. PCT/FI01/00616, filed Jun. 28, 2001, and claims priority on Finnish Application No. 20001587 filed Jul. 3, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in changing the blade setting of a slitter-winder, in which method the setting of blades is changed during slitting in order to slit component webs of different widths, in which connection the width of the edge trimming which is formed changes and wherein an untrimmed neck remains between the edge trimmings of different widths which are formed when slitting according to a different blade setting.

The invention also relates to an apparatus in changing the blade setting of a slitter-winder.

As known in the state of the art, a slitter-winder is used for slitting a paper web in a longitudinal direction into component webs, which are wound into component rolls. When the width of desired component rolls changes, the slitting blades of the slitting part in the slitter-winder are set in the width direction of the paper web at a desired distance from one another in order to produce component rolls of the desired width, that is, a change of the blade setting is performed. The edge trimming remaining at the edge of the paper web is guided through a trim spout into a pulper. In connection with the change of the blade setting, when the position of blades in the slitter-winder's slitting part changes, the width of the edge trimming may, of course, also change. As known in the state of the art, the untrimmed neck remaining between the edge trimmings according to a new and an old blade setting has been torn manually in order to enable the edge trimming to be passed through the trim spout into the pulper.

Today, one aim is to make the slitter-winder and the operations associated therewith such that its running demands only one person, who controls the operation of the slitter-winder from a control room. The removal of the neck between the edge trimmings slit in accordance with a new and an old blade setting by tearing a piece out of said point, as described above, has been a manual operation, with the result that the other duties associated with the operation of the slitter-winder are interrupted and the slitter-winder cannot start until the neck has been removed. This reduces the production capacity of the slitter-winder. In addition, another worker has often been needed to perform this operation which must be done by hand. This manual operation is also a risk in terms of work safety, because it is performed in a dangerous place close to cutting blades.

The invention aims at eliminating the problems described above.

SUMMARY OF THE INVENTION

It is a particular object of the invention to provide a method and an apparatus which when used eliminate from the slitter-winder the above-mentioned manual operation in connection with removal of the neck between the edge trimmings slit in accordance with a new and an old blade setting.

It is object of the invention to provide an automatic arrangement for eliminating the untrimmed neck produced between the edge trimmings in connection with the change of the blade setting.

It is an object of the invention to provide a method and an apparatus, whereby the use of time of the crew operating the slitter-winder is made more effective, thereby allowing the production capacity to be increased.

With a view to achieving the above-noted objects as well as those coming out later, the method according to the invention is mainly characterised in that, in the method, a cutting apparatus is used for making a cut between the slitting line of an edge trimming according to an old blade setting and the slitting line of an edge trimming according to a new blade setting controlled by a control system of the cutting apparatus.

The apparatus according to the invention is in turn mainly characterised in that the apparatus comprises a cutting member for making a cut between the edge trimmings of different widths produced in connection with the change of the blade setting in slitting, and that the apparatus comprises a control system for controlling the operation of the cutting apparatus.

In accordance with the invention, the apparatus is placed in connection with the slitter-winder to make a cut automatically between the slitting lines of a new and an old blade setting, so that no neck found in the applications known from the state of the art is formed.

In the method according to the invention, a cut between the slitting lines of blade settings is thus made mechanically, which means that no manual steps are needed and the operation can be controlled from the control room, a single person being able to attend to the slitter-winder and to the operations associated therewith. In this way, the operating crew's use of time is enhanced and, at the same time, a higher production capacity is achieved.

The apparatus according to the invention comprises a cutting member and a control device for guiding the cutting member from the slitting point of the old blade setting to the slitting point of the new blade setting. Preferably, there is also a measuring device in connection with the apparatus for measuring the position of the cutting member. The control unit also relays information to the cutting member about the blade setting at which the blades of the slitter-winder are to be placed and at which setting they have been placed.

The measuring device advantageously provided in connection with the apparatus according to the invention is needed if expressly only that area is desired to be cut in which an untrimmed neck would be otherwise produced so that in later stages of treatment of the web, for example, when gluing the web end, there shall remain no area from which any glue would get to the surface of a roll or to a winding cylinder.

According to an advantageous feature, supports are arranged in connection with the apparatus according to the invention for guiding the web to run along a desired path at the cutting member.

In accordance with the invention, the neck area is preferably cut before the web moves to the blades of the slitter-winder's slitting part, advantageously when the web runs at a crawl speed. The cutting point is selected so that it is suitable for guidance of the edge trimming.

The cutting member used in connection with the equipment according to the invention may be a cutting blade of many different types, a water-jet cutter or equivalent.

A device for forming a wedge in threading/a splicing device arranged in connection with the slitter-winder and equipped with a suitable control unit and preferably with an accurate measuring device may also be advantageously used as the apparatus according to the invention.

BRIEF DESCRIPTION OF THE DRAWINGS

In the following, the invention will be described in greater detail with reference to the figures in the appended drawings, to the details of which the invention is, however, not by any means meant to be narrowly confined.

DESCRIPTION OF THE PREFERRED EMBODIMENTS

Figure 1:
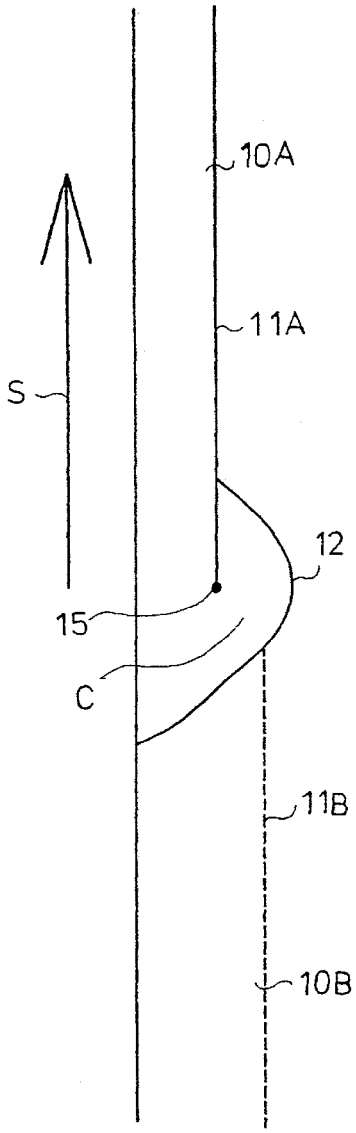
FIG. 1 PRIOR ART
FIG. 1 schematically shows a stage in the situation known in the state of the art when the blade setting is changed in a slitter-winder.

In the state-of-the-art situation shown in FIG. 1, the reference arrow S designates the direction in which a web is running. Slitting according to a previous blade setting of a slitter-winder takes place along the line 11A, in which connection an edge trimming 10A is formed. The dashed line 11B designates the slitting line according to a new blade setting. The edge trimming 10B which is being formed is wider than the edge trimming 10A according to the previous blade setting. The line 12 designates a tear which results when a piece is torn away manually in order to remove an untrimmed neck C. The position of the slitting blades of the slitter-winder's slitting part is at the point 15, where the slitting according to the previous blade setting ends.

Figure 2:
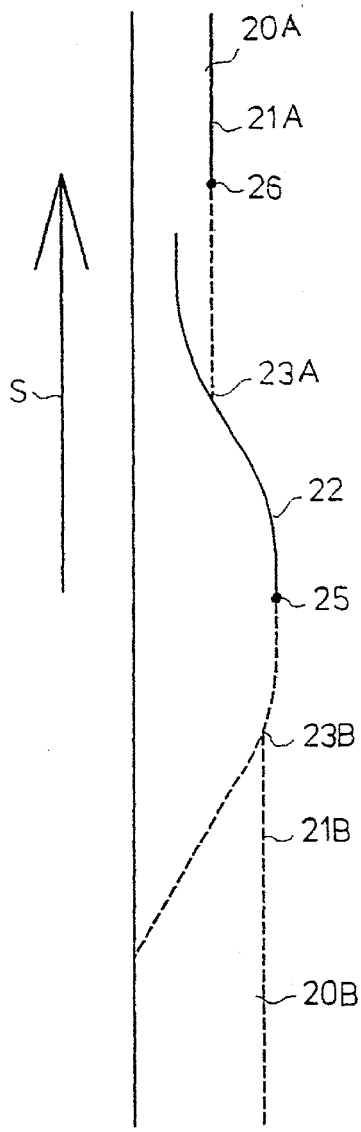
FIG. 2 is a schematic view of an arrangement according to the invention when changing the blade setting in a slitter-winder.

FIG. 2 shows a situation corresponding to the arrangement according to the invention. The reference arrow S designates the running direction of the web. Slitting according to an old (previous) blade setting has taken place along the line 21A, and the edge trimming which is formed is designated by the reference numeral 20A. The reference numeral 26 designates the position of the slitting blades of the slitter-winder's slitting part. The reference numeral 23A designates the end point of the edge slitting according to the old blade setting in relation to the web. The dashed line 21B designates the slitting line of a new blade setting and the reference numeral 20B designates the edge trimming which is formed. The starting point of the edge slitting according to the new blade setting in relation to the web is designated by the reference numeral 23B. The reference numeral 25 designates the position of a cutting member by which a diagonal cut 22 is made between the slitting lines according to the old and the new blade setting.

In the situation of FIG. 2 described above, the old edge trimming 20A has been narrower than the new edge trimming 20B, but, of course, the situation may also be the other way round.

Figure 3A:
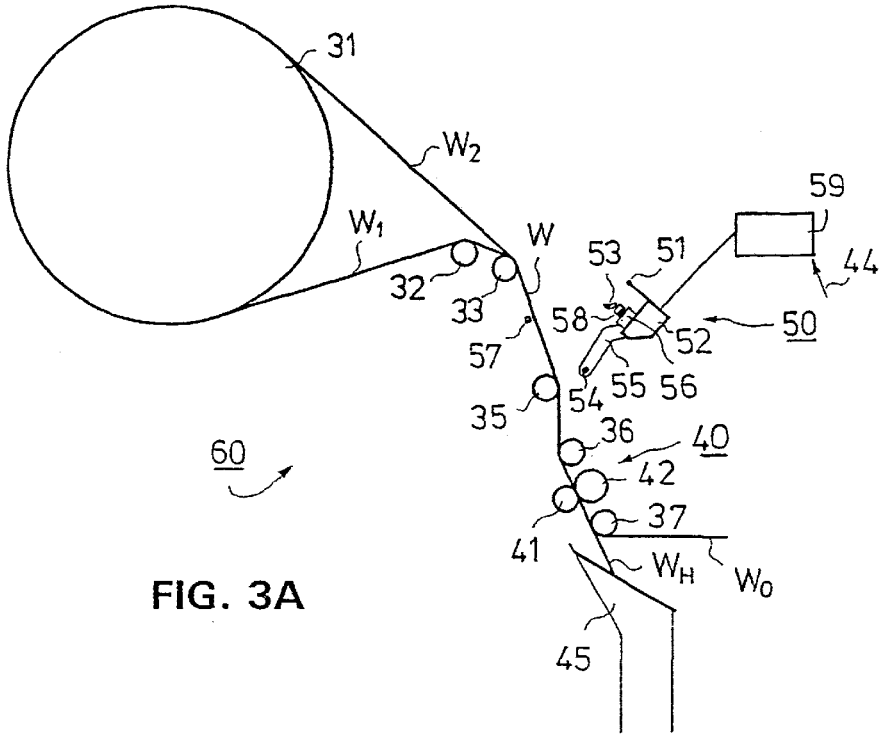
FIG. 3A is a schematic view of a slitter-winder in connection with which an apparatus according to the invention has been placed in a rest position.
Figure 3B:
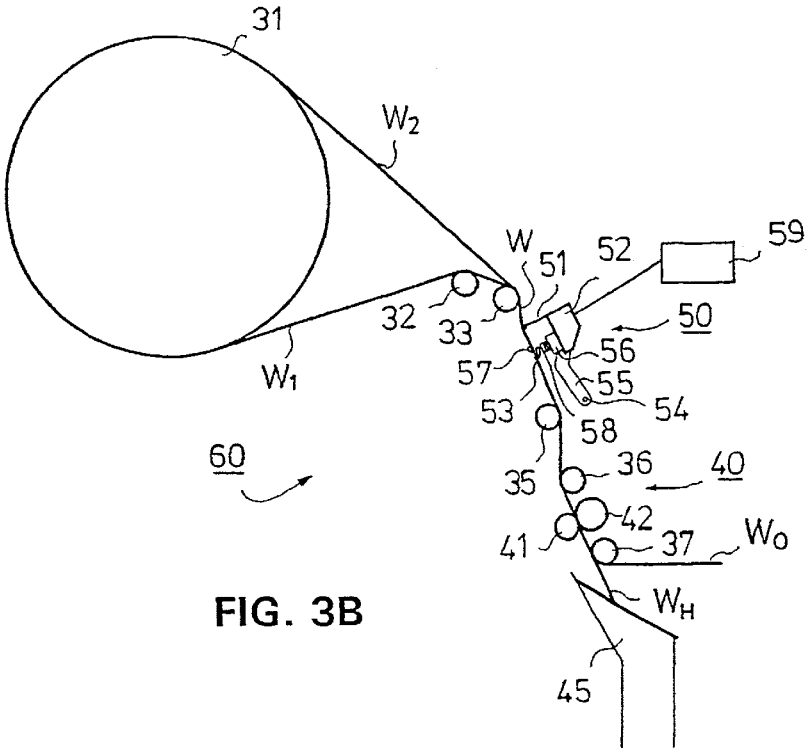
FIG. 3B shows the application example shown in FIG. 3A in a situation where the cutting apparatus according to the invention is in operation.

FIGS. 3A and 3B illustrate one advantageous application example of the invention in connection with a slitter-winder 60. As shown in FIGS. 3A and 3B, a paper web W is unwound from a paper reel 31. The web W may come either from below, as indicated by the reference sign $W_1$, or from above, as indicated by the reference sign $W_2$. Guide rolls of the paper web W are designated by the reference numerals 32, 33, 35, 36 and 37. The slitting part 40 of the slitter-winder 60 comprises a bottom blade 41 and a top blade 42, and there are several such blade pairs 41, 42 in the width direction of the web W and the web W is slit by means of them into component webs $W_O$, which are guided to be wound into component rolls. The edge trimming which is being formed is designated by the reference sign $W_H$ and it is guided into a trim spout 45. A cutting apparatus 50 according to the invention for making a cut between the slitting lines of an old and a new blade setting has been placed in the application example shown in FIGS. 3A and 3B before the slitting part 40 on the run of the web W between guide rolls 33 and 35. The cutting apparatus 50 according to the invention includes a cutting member 53 placed in a holder 58 attached to frame structures 56 at the end of an arm 55 articulated with a joint 54. The apparatus also includes a measuring device 52 for measuring the position of the cutting member 53, and a support member 51 for keeping the web W at a suitable point with respect to the cutting apparatus 50. The measuring device 52 has been connected to a control system 59, which also receives information about the blade setting of the slitter-winder, as shown by the arrow 44. On the other side of the web W with respect to the cutting apparatus 50, a support member 57 has been arranged to support the web W at the cutting point.

In FIG. 3A, the apparatus according to the invention is in a rest position waiting for the next change of the blade setting in order to make a cut. In the situation shown in FIG. 3B, the cutting apparatus 50 is in the cutting position, in which connection a cut is made by means of it between the slitting lines of the edge trimmings formed in slitting according to the new and old blade settings, as shown in FIG. 2.

The invention has been described above only with reference to one advantageous application example thereof, but the invention is by no means meant to be narrowly confined to the details of this example.

What is claimed is:

1. A method for changing the blade setting of a slitter-winder, comprising the steps of:

advancing a web in a machine direction through the slitter-winder, a cross machine direction being defined perpendicular to the machine direction;

slitting the web into a plurality of component webs of first widths and a first edge trimming of a second width by passing the web over blades located at first positions spaced from one another in the cross machine direction, the first edge trimming being defined along a first slitting line at a first cross machine position;

changing the positions of the blades in the cross machine direction in order to slit component webs of widths different than the first widths and form a second edge trimming of a third width different than the second width, the second edge trimming being defined along a second slitting line at a second cross machine position, to thereby form a neck extending between the first edge trimming of a second width and the second edge trimming of a third width; and controlling a cutting apparatus with a control system to make a cut with the cutting apparatus between the first cross machine position corresponding to the first slitting line of the first edge trimming and the second cross machine position corresponding to the second slitting line of the second edge trimming.

2. The method of claim 1 wherein the cutting apparatus has a cutting member which make the cut, and further comprising the step of measuring the position of the cutting member of the cutting apparatus with a measuring device.

3. The method of claim 1 wherein the web is supported along a run, and the run of the web is controlled by support members.

4. The method of claim 1 wherein the web is supported by a support member from a side opposite to the cutting apparatus.

5. The method of claim 1 wherein the step of making a cut with the cutting apparatus is performed on the web before the position to the slitting step.

6. The method of claim 1 further comprising the step of passing information on the setting positions of the blades to the control system.

7. A method of changing the blade setting of a slitter-winder, comprising the steps of:

advancing a web in a machine direction through the slitter-winder, a cross machine direction being defined perpendicular to the machine direction;

slitting the web into a plurality of component webs of the first widths and a first edge trimming of a second width by passing the web over the blades located at first positions spaced from one another in the cross machine direction, the first edge trimming being defined along a first slitting line at a first cross machine position;

changing the position of the blades in the cross machine direction in order to slit component webs of widths different than the first widths, and form a second edge trimming of a third width different than the second width, the second edge trimming being defined along a second slitting line at a second cross machine position, to thereby form a neck extending between the first edge trimming a second width and the second edge trimming of a third width;

controlling a cutting apparatus with a control system to make a cut in the web with the cutting apparatus at a position upstream of the blades prior to the slitting of the web by the blades, the cut extending between the first cross machine position corresponding to the first slitting line of the first edge trimming and the second cross machine position corresponding to the second slitting line of the second edge trimming.

8. A slitter-winder for slitting a web into a plurality of component webs and an edge trimming, the slitter-winder comprising:

a plurality of blades positionable at a first slitting setting spaced first distances in the cross machine direction and at a second slitting setting having different cross machine direction blade positions, the web moving in a machine direction to form, at the first slitting setting, a first edge trimming of a first width defined along a first slitting line, and to form at a second slitting setting, a second edge trimming of a second width which is different than the first width, the second edge trimming being defined along a second slitting line;

a cutting apparatus having a cutting member for making a cut between the locations of the first slitting line and the second slitting line produced in connection with the change of the blade setting in slitting; and a control system for controlling the operation of the cutting apparatus, and changing the cross machine direction setting of the plurality of blades during slitting in order to slit component webs of different widths, in which connection the width of the edge trimming which is formed changes.

9. The apparatus of claim 8 further comprising a measuring device for measuring the position of the cutting member of the cutting apparatus.

10. The apparatus of claim 8 further comprising support members for supporting the web and for controlling the run of the web.

11. The apparatus of claim 8 further comprising a support member arranged in connection with the cutting apparatus on the side of the web opposite to the cutting apparatus for supporting the web during the cutting operation performed by the cutting apparatus.

12. The apparatus of claim 8 wherein the cutting apparatus is positioned upstream with respect to the plurality of blades.

* * * * *